US009662255B2

(12) United States Patent
Wechter

(10) Patent No.: US 9,662,255 B2
(45) **Date of Patent: *May 30, 2017**

(54) ADAPTATION TO AN ASSISTIVE DEVICE

(71) Applicant: Brian J. Wechter, Canton, GA (US)

(72) Inventor: Brian J. Wechter, Canton, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/828,380

(22) Filed: Aug. 17, 2015

(65) Prior Publication Data

US 2015/0351591 A1 Dec. 10, 2015

Related U.S. Application Data

(63) Continuation of application No. 13/441,987, filed on Apr. 9, 2012, now Pat. No. 9,107,787, which is a continuation of application No. 11/750,104, filed on May 17, 2007, now Pat. No. 8,152,233.

(60) Provisional application No. 60/747,621, filed on May 18, 2006.

(51) Int. Cl.

| | |
|---|---|
| ***A47C 1/00*** | (2006.01) |
| ***A47C 13/00*** | (2006.01) |
| ***A47C 15/00*** | (2006.01) |
| ***A47B 1/04*** | (2006.01) |
| ***A47B 85/00*** | (2006.01) |
| ***A47B 85/04*** | (2006.01) |
| ***A61G 7/10*** | (2006.01) |
| ***A47C 4/00*** | (2006.01) |
| ***A47K 3/12*** | (2006.01) |

(52) U.S. Cl.

CPC ..... *A61G 7/1003* (2013.01); *A47C 1/00* (2013.01); *A47C 4/00* (2013.01); *A47K 3/122* (2013.01)

(58) Field of Classification Search

CPC ..... A61G 7/1003; A47C 4/00; A47C 1/00; A47K 3/122

USPC ..... 297/119, 124, 129, 344.18, 354.13, 107, 297/108, 109, 233, 248; 108/69, 71; 4/578.1, 560.1, 571.1, 573.1, 579, 604; 5/81.1 R, 83.1, 87.1

See application file for complete search history.

(56) References Cited

U.S. PATENT DOCUMENTS 33,192 A * 9/1861 Gurley et al. ..... A47C 17/165 297/109

80,322 A * 7/1868 Williams ..... A47C 1/023 297/107

(Continued)

FOREIGN PATENT DOCUMENTS

WO WO 0170088 A1 * 9/2001 ..... A47K 3/122

*Primary Examiner* — Rodney B White

(74) *Attorney, Agent, or Firm* — Michael P. Kochka, Esq.

(57) ABSTRACT

Embodiments generally relate to transfer benches and, more particularly, to a transfer bench adapted to facilitate the movement into and out of an enclosure, such as a bathtub, by persons having limited mobility. A transfer bench may include first seating section, a second seating section rotatably coupled to said first seating section and configured to rotate from and between a substantially horizontal position to a substantially vertical position, wherein the second seating section cannot rotate more than about 90 degrees from the horizontal position, a first plurality of legs configured to support the first seating section, a second leg configured to support the second seating section, and a back support member extending from a side of the first seating section perpendicular to an axis of rotation of the second seating section.

8 Claims, 11 Drawing Sheets

(56) References Cited

U.S. PATENT DOCUMENTS 126,266 A * 4/1872 Coates ..... A47C 17/62 297/109
134,875 A * 1/1873 Fauh ..... A47C 17/165 297/109
153,665 A * 8/1874 Coates ..... A47C 17/165 297/107
164,370 A * 6/1875 Ham ..... A47C 17/207 297/110
173,071 A * 2/1876 Sheldon ..... A47C 1/026 297/108
189,964 A * 4/1877 Stevens et al. .... A47C 17/2073 297/108
203,605 A * 5/1878 Eastman ..... A47C 17/2073 297/108
212,778 A * 2/1879 Woolverton ..... A47C 17/207 297/110
259,953 A * 6/1882 Welsh et al. ..... A47D 11/005 297/108
262,901 A * 8/1882 Kulich ..... A47C 17/20 297/108
863,874 A * 8/1907 Rajner ..... A47C 17/18 297/105
885,234 A * 4/1908 Eriksson ..... A47C 17/2073 297/106
1,024,944 A * 4/1912 McCaffrey ..... A47C 17/2073 297/108
1,061,533 A * 5/1913 Englander ..... A47C 17/2076 297/108
1,335,973 A * 4/1920 Kesselman ..... A47C 1/023 297/107
1,347,417 A * 7/1920 Sturk ..... A47C 17/22 297/106
1,369,543 A * 2/1921 Reider ..... B61C 17/04 297/234
1,421,929 A * 7/1922 Floreskul ..... A47B 3/087 190/12 R
1,597,922 A * 8/1926 Osborn ..... A47K 3/122 4/575.1
2,173,993 A * 9/1939 Amdur ..... A47K 3/38 160/349.1
2,237,076 A * 4/1941 Kenney ..... A47K 3/122 4/579
2,965,153 A * 12/1960 Purcell, Sr. ..... A47K 3/122 108/33
3,596,981 A * 8/1971 Koziol ..... B60N 2/34 297/154
3,855,646 A * 12/1974 Glickman ..... A47K 3/122 297/383
4,155,588 A * 5/1979 Danziger ..... A61G 5/00 297/115
4,166,297 A * 9/1979 Saleeby ..... A47K 3/122 108/47
4,288,124 A * 9/1981 Hamilton ..... A61G 3/06 297/233
4,446,796 A * 5/1984 Wilson ..... A47B 31/04 108/69
4,453,732 A * 6/1984 Assanah ..... A61G 5/006 280/250.1
4,472,844 A * 9/1984 Mace ..... A47K 3/122 4/579
4,508,384 A * 4/1985 Castelot ..... A47C 1/143 297/108
4,750,432 A * 6/1988 McNamara ..... A47B 31/04 108/69
4,768,239 A * 9/1988 Pauley ..... A61G 7/1003 4/564.1
5,251,956 A * 10/1993 Hofmeyer ..... A47C 1/143 297/144
5,335,377 A * 8/1994 Masyada ..... A47K 3/122 297/152
5,341,525 A * 8/1994 Tillman ..... A47K 3/122 4/573.1
5,342,114 A * 8/1994 Burke ..... A61G 5/006 297/344.2
5,361,428 A * 11/1994 Nanowsky ..... A47K 3/122 4/558
5,403,082 A * 4/1995 Kramer ..... A47B 21/00 108/115
5,517,704 A * 5/1996 Dagostino ..... A47K 3/122 4/480
5,647,632 A * 7/1997 Fireman ..... A47C 13/00 297/109
5,790,997 A * 8/1998 Ruehl ..... A47C 17/162 297/316
5,865,505 A * 2/1999 Eley ..... A61G 15/02 128/845
5,937,454 A * 8/1999 Drew ..... A61G 7/1003 297/344.18
5,940,905 A * 8/1999 Cheng ..... A47K 3/122 4/560.1
5,971,485 A * 10/1999 Clark ..... A61G 13/009 297/195.11
6,039,403 A * 3/2000 Hargroder ..... A47K 3/122 297/440.16
6,105,183 A * 8/2000 Bly ..... A47K 3/122 297/94
6,182,304 B1 * 2/2001 Freeberg ..... A47K 3/122 4/560.1
6,256,806 B1 * 7/2001 DiTommaso ..... A47K 3/122 4/560.1
6,279,178 B1 * 8/2001 Hill ..... A47K 3/122 4/560.1
6,520,093 B1 * 2/2003 Merl ..... A47B 1/04 108/69
6,547,330 B1 * 4/2003 Hester ..... A61G 5/006 297/322
6,681,415 B1 * 1/2004 Gallo ..... A47K 3/122 4/578.1 X
6,773,059 B2 * 8/2004 Volotsenko ..... A47C 13/00 297/129
6,792,633 B1 * 9/2004 Ito ..... A61G 5/006 5/618
6,805,406 B1 * 10/2004 Jansen ..... A61G 5/1064 280/304.1
6,842,919 B2 * 1/2005 Wilson ..... A47K 3/282 297/180.15
6,886,194 B2 * 5/2005 Hodgetts ..... A61G 5/006 280/648
6,899,392 B1 * 5/2005 Saberan ..... B60N 2/206 297/317
7,025,420 B2 * 4/2006 Guinea Pena ..... B60N 2/34 297/354.13
7,114,770 B2 * 10/2006 Murphy ..... A47C 1/0355 297/423.26
7,182,404 B2 * 2/2007 Laurent ..... B60N 2/34 297/173
7,661,154 B2 * 2/2010 Cheng ..... A47K 3/122 4/560.1
7,980,584 B2 * 7/2011 Goldstein ..... A61G 5/1002 280/304.1
8,152,233 B2 * 4/2012 Wechter ..... A47K 3/122 108/69
8,157,287 B1 * 4/2012 Cleveland ..... A61G 5/006 280/30
8,162,396 B2 * 4/2012 Edwards ..... A47C 4/02 297/188.08
8,181,285 B1 * 5/2012 Jackson ..... A47K 3/122 297/16.1
8,276,984 B1 * 10/2012 Jamison, Jr. ..... A47C 17/14 297/119
9,107,787 B2 * 8/2015 Wechter ..... A47K 3/122
2004/0051365 A1 * 3/2004 Darst ..... A47K 3/282 297/440.1
2004/0080201 A1 * 4/2004 Verny ..... B64D 11/06 297/354.13
2005/0127721 A1 * 6/2005 Kong ..... A47C 4/02 297/119

(56) References Cited

U.S. PATENT DOCUMENTS

| | | | | |
|---|---|---|---|---|
| 2006/0213007 | A1* | 9/2006 | Palay | A61G 3/02 5/81.1 R |
| 2006/0260041 | A1* | 11/2006 | Paz | A61H 7/001 4/573.1 |
| 2008/0092288 | A1* | 4/2008 | Cheng | A47K 3/122 4/578.1 |
| 2011/0035876 | A1* | 2/2011 | Chang | A61G 5/006 5/81.1 R |
| 2011/0289677 | A1* | 12/2011 | Huang | A61G 7/1034 5/81.1 R |
| 2011/0289678 | A1* | 12/2011 | Huang | A61G 7/1034 5/81.1 R |
| 2012/0274103 | A1* | 11/2012 | Kenttamaa-Squires | A47C 1/035 297/129 |
| 2012/0292952 | A1* | 11/2012 | Tyson, III | A47C 1/14 297/129 |
| 2013/0117928 | A1* | 5/2013 | Hardie | A47K 3/282 4/611 |
| 2016/0176315 | A1* | 6/2016 | Moore | B60N 2/0292 297/108 |

* cited by examiner

ADAPTATION TO AN ASSISTIVE DEVICE

CROSS-REFERENCE TO RELATED APPLICATION

This application is a continuation of U.S. patent application Ser. No. 13/441,987, filed Apr. 9, 2012, entitled "Adaptation to an Assistive Device," which is a continuation-in-part of U.S. patent application Ser. No. 11/750,104, filed May 17, 2007, entitled "Adaptation to an Assistive Device," now U.S. Pat. No. 8,152,233, which claims priority to U.S. Provisional Application Ser. No. 60/747,621, filed May 18, 2006. Such applications are incorporated by reference in their entireties as if fully set forth herein.

BACKGROUND OF THE INVENTION

Field of the Invention

Embodiments of the present invention generally relate to transfer benches and, more particularly, to a transfer bench adapted to facilitate the movement into and out of an enclosure, such as a bathtub, by persons having limited mobility.

Description of the Related Art

Movement into and out of a wet environment, such as a bathtub, can be difficult for persons having limited mobility. Such movement, for a person with a standard level of mobility, normally requires a minimal amount of effort and care to maintain safety. However, for persons with limited mobility such as invalids, handicapped, disabled, or other persons with conditions that limit the functionality of muscles, the minimal amount of effort and care often precludes the safe use of a bathtub or other wet environment.

Currently known devices that may assist a person upon entry or exit of a wet environment do not adequately protect the safety of the person. For example, the devices may not allow for enclosure of the wet environment, such as by a door or curtain, and thus allow for water to spill beyond the periphery of the wet environment. This can further compromise the safety of the individual.

Thus, there is a need in the art for a device and methods of using same that facilitates the movement into and out of a wet environment while maximizing safety to an individual.

SUMMARY

Embodiments of the present invention generally relate to transfer benches and, more particularly, to a transfer bench adapted to facilitate the movement into and out of an enclosure, such as a bathtub, by persons having limited mobility.

In one embodiment of the present invention, a transfer bench comprises a first seating section, a second seating section rotatably coupled to said first seating section and configured to rotate from and between a substantially horizontal position to a substantially vertical position, wherein the second seating section cannot rotate more than about 90 degrees from the horizontal position, a first plurality of legs configured to support the first seating section, a second leg configured to support the second seating section, and a back support member extending from a side of the first seating section perpendicular to an axis of rotation of the second seating section.

In another embodiment of the present invention, A bathtub assembly comprises a bathtub having an enclosure, the enclosure comprising a tub having a floor surface and sidewalls; and a transfer bench comprising: a first seating section; a second seating section rotatably coupled to said first seating section and configured to rotate from and between a substantially horizontal position to a substantially vertical position, wherein the second seating section cannot rotate more than about 90 degrees from the horizontal position; a first plurality of legs configured to support the first seating section, the first plurality of legs affixed to the tub; a second leg configured to support the second seating section; and a back support member extending from a side of the first seating section perpendicular to an axis of rotation of the second seating section.

In yet another embodiment of the present invention, a transfer bench comprises: a frame having a slidable rail positioned thereon, the frame having a first section and a second section; a slidable seating section affixed on the slidable rail for sliding from the first section to the second section; the second section rotatably coupled to said first section and configured to rotate from and between a substantially horizontal position to a substantially vertical position, wherein the second section cannot rotate more than about 90 degrees from the horizontal position; a first plurality of legs configured to support the first section; a second leg configured to support the second section; and a back support member extending from a side of the first section perpendicular to an axis of rotation of the second section.

BRIEF DESCRIPTION OF THE DRAWINGS

So the manner in which the above-recited features of the present invention can be understood in detail, a more particular description of embodiments of the present invention, briefly summarized above, may be had by reference to embodiments, which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein.

Figure 1:
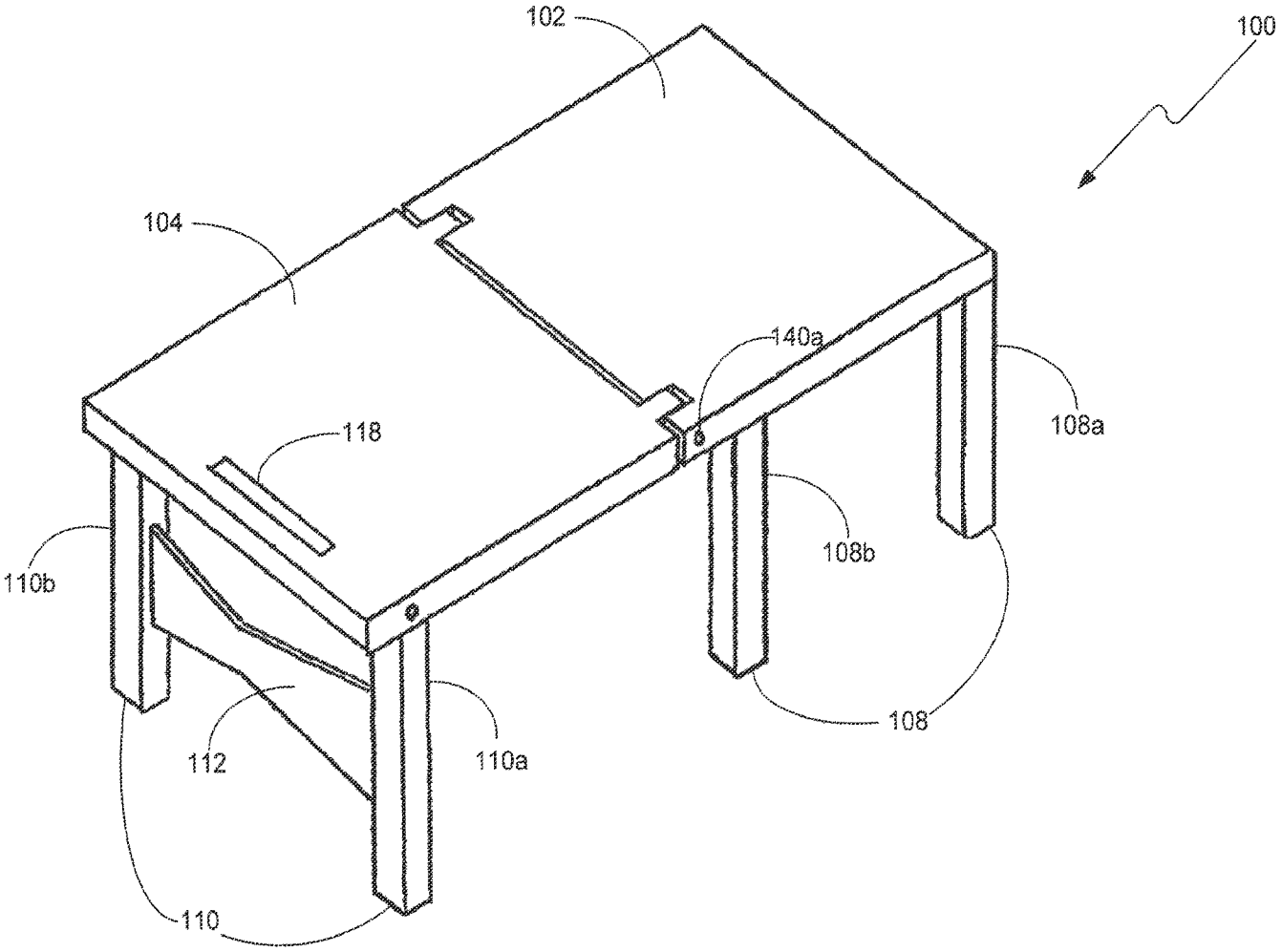
FIG. 1 depicts a schematic diagram of a perspective view of a transfer tub bench, in accordance with one embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

The present invention may be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular embodiments only and is not intended to be limiting.

As used in the specification and the appended claims, the singular forms "a," "an" and "the" include plural referents unless the context clearly dictates otherwise. Thus, for example, reference to a "leg" can include two or more such legs unless the context indicates otherwise.

Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Figure 3:
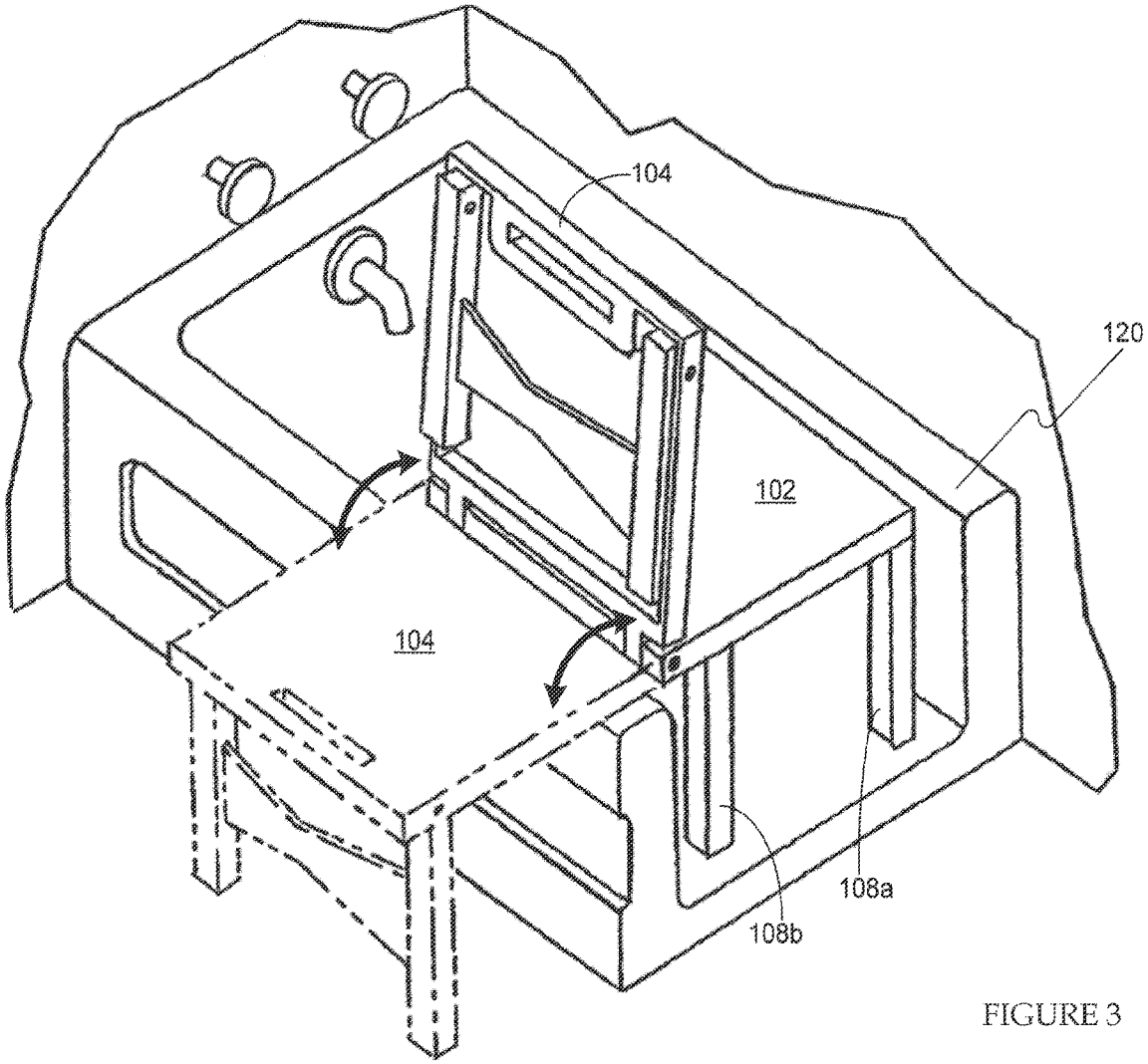
FIG. 3 depicts a diagram illustrating the positioning of a transfer tub bench within a bathtub, in accordance with one embodiment of the present invention.
Figure 4:
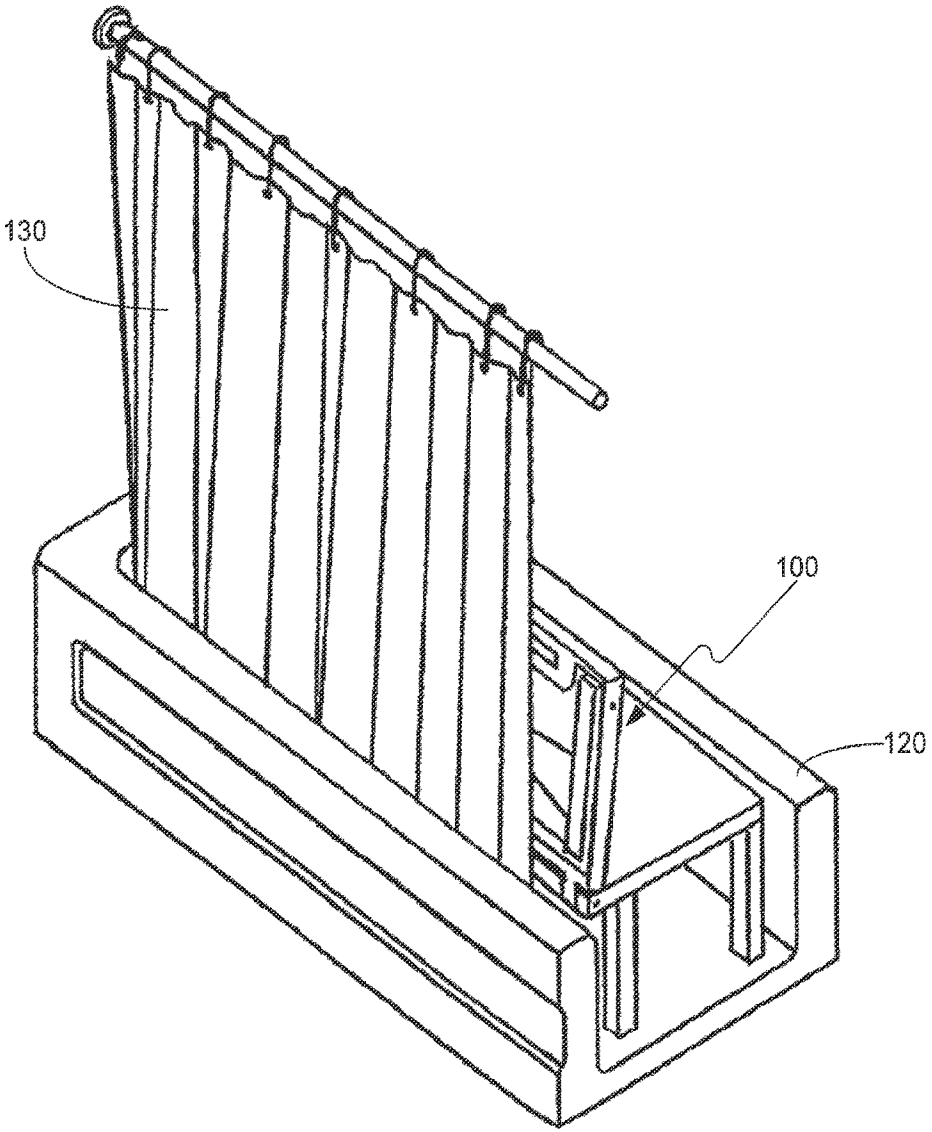
FIG. 4 depicts a diagram illustrating the positioning of a shower curtain proximate a bathtub having a transfer tub bench disposed therein, in accordance with one embodiment of the present invention.

According to various embodiments of the present invention, a transfer bench is disclosed for use in an enclosure having a base and a periphery of a predetermined height. In some embodiments, the enclosure may be a wet/dry environment, such as a bathtub, shower enclosure (such as a shower stall or shower closet), hot tub, pool, and the like. Optionally, the transfer bench can be used in any suitable environment. Thus, although use of a transfer device is illustrated in FIGS. 3 and 4 in association with a bathtub, it will be apparent to those of ordinary skill in the art that a transfer bench can be used in association with any environment to provide, at least, the disclosed functions. It will be further appreciated that a "person" or "user" of a transfer bench as used herein is intended to encompass the direct user of the transfer bench and/or a designated assistant, such as a nurse, aide, helper, or other care-giver.

The periphery of the enclosure, in some embodiments, may have a negligible predetermined height or a predetermined height of zero. For instance, many locker rooms and similar bathing environments have shower stalls with a base that is approximately level with the surrounding floor. Thus, in such shower stalls, at least a portion of the periphery may have a height of zero. In a traditional bathtub, the periphery may have a height of several inches to several feet. In various embodiments, the height of the periphery may vary along the length of the periphery. In further embodiments, the periphery may defined by a wall (such as in a bathtub), a lip, a shower curtain, a door (such as a door that swings open or slides along a track), other enclosing means, or any combination of these.

A transfer bench, according to one embodiment of the present invention, comprises a first seating section and a second seating section that is coupled to the first seating section. With reference to FIG. 1, a transfer bench 100 can comprise a first seating section 102, at least a portion of which substantially lies in a substantially horizontal plane. In one embodiment, the first seating section can be substantially planar. Optionally, the first seating section can be shaped to receive at least a portion of a person's posterior. The second seating section 104 can likewise be substantially planar or can be shaped to receive at least a portion of the person's posterior.

In a particular embodiment, the second seating section 104 can be coupled or attached to the first seating section 102 in a rotatable manner and can be positioned from and between a first position and a second position. As illustrated in FIG. 3, in one embodiment, the first position is a generally horizontal position in which the second seating section is substantially coplanar with the first seating section. The second position can be a generally upright or vertical position in which the second seating section is generally perpendicular to the first seating section. As described herein, a generally horizontal position can refer to a position that is sufficiently horizontal to prevent a user from slipping or sliding off of the first and/or second seating section when in use. A generally vertical position of the second seating section can include a vertical, nearly vertical, or inclined past vertical position, in relation to the position of the first seating section.

The two seating sections can be coupled by various means that allow this movement. For example, the second seating section can be hingedly attached to the first seating section such as by one or more hinges 140. Optionally, the seating sections can be coupled by a pin and hole configuration, a pin and slot configuration, a detent and hole configuration, or any other manner that allows for relative rotational movement of the second seating section. Means can also be provided for selectively maintaining the second seating section in the second position, such as latching or other securing means. Either or both of the first and second seating sections can also comprise water drainage means to drain water from the respective surfaces when the transfer bench is used in a wet environment. Such water drainage means can include holes, slots, channels, or a combination thereof, configured and positioned in a manner that facilitates water drainage from the surface of the respective seating surface.

In one embodiment, the second seating section can comprise a handhold, such as for assisting in stabilizing the user, providing the user with means to move the second seating section from the first position to the second position, or for other purposes. The handhold can be a handle, an aperture 118 that extends through the second seating section, such as shown in FIG. 1, or other means. Additional means can be provided for assisting the user in rotating the second seating section to and between the first and second positions, such as a pull cord or other means disposed within, upon, or attached to the second seating section. In one embodiment, the latching means, such as described above, can be operatively connected to a handhold or other handling means disposed on or within the second seating section. For example, the handhold can comprise a squeezable mechanism positioned within an aperture extending through the second seating section. A user can grab the handhold to manipulate the second seating section into a vertical position, and the latching mechanism can engage to maintain the second seating section in this position. When the user desires to rotate the second seating section to the horizontal position, the user can squeeze the squeezing mechanism of the handhold to disengage the latching mechanism.

In one embodiment, other means can be provided to support a user, such as one or more arm rests, a back support, etc. The second seating section when in the vertical position can also support the user, such as by limiting lateral movement of the user or providing a support against which the user can lean or rest. In a particular embodiment, the first seating section can comprise a first edge and an opposing edge. The second seating section can be rotatably coupled to the first seating section proximate the first edge, and an arm rest can be positioned proximate the second edge. In yet another embodiment, the transfer bench can comprise a back support. The back support can extend from the first seating section at a selected angle. For example, the back support can extend substantially vertically upward from the first seating section. Optionally, the back support can extend at an angle selected at or between horizontal and vertical to allow the user to lie back against the back support. In yet another embodiment, the back support can have means for adjusting the angle relative to the first seating section to allow the user to position the back support means to any angle. In some embodiments, one or more arm rests and a back support can be provided. Thus, the transfer bench can comprise arm rest(s), a back support, or both. In any embodiment in which an arm rest and/or back support is provided, the arm rest(s) and/or back support can be removably attached to the transfer bench. Means can also be provided for attaching the back support proximate one or more edges of the first seating section so that the transfer bench can be used in various enclosures. Optionally, the arm rest(s) and/or back support can be fixedly attached to the transfer bench.

The first and second seating sections are shown as substantially rectangular in FIG. 1 for illustrative purposes only; it is contemplated that each of the seating sections can be of any size and shape to receive and support a user. In one embodiment, the second seating section can be sized and shaped such that when the transfer bench is positioned in an enclosure, the second seating section is configured to extend beyond the periphery of the enclosure when in the first position. One or both of the seating sections can comprise a material configured to support the weight of a user and allow the lateral movement (such as sliding movement) of the user across the first and/or second seating sections. Such material can be high-strength plastic, metal, wood, wood composites, aluminum, fiberglass, combinations thereof, or other materials suitable for use.

In a further embodiment, a plurality of support means is provided to support each of the first and second seating sections. The support means, in one embodiment, are at least as tall as the predetermined height of the periphery of the enclosure. For example, as shown in FIG. 1, at least one first leg 108 can be provided to support the first seating section 102 and at least one second leg 110 can be provided to support the second seating section 104. In a particular embodiment, at least four legs can be provided to support the first seating section and at least two legs can be provided to support the second seating section, although other arrangements are contemplated within the scope of the present invention. For example, the first seating section can be supported by more or fewer than four legs and the second seating section can be supported by more or fewer than two legs.

In the particular embodiment in which the first seating section is supported by four legs and the second seating section is supported by two legs, when the second seating section is in a generally horizontal position and is substantially coplanar with the first seating section, the transfer bench will be supported by at least six legs. When the second seating section is in a generally vertical position or between the generally horizontal and generally vertical positions, the transfer bench will be supported by the at least four legs supporting the first seating section. In any embodiment, each leg can have rubber, soft plastic, suction cup, or other material or means disposed at a foot or distal end of the leg to absorb shock, stabilize the leg, and/or protect the finish of the surface on which the transfer bench is supported. Additional stability can be provided through stiffening members attached or mounted between two or more legs. For example, as shown in FIG. 1, a stiffening member 112 can be provided between legs 110 that support the second seating section 104. Stiffening members or other support or stiffening means likewise can be provided between legs 108 that support the first seating section 102.

Figure 2:
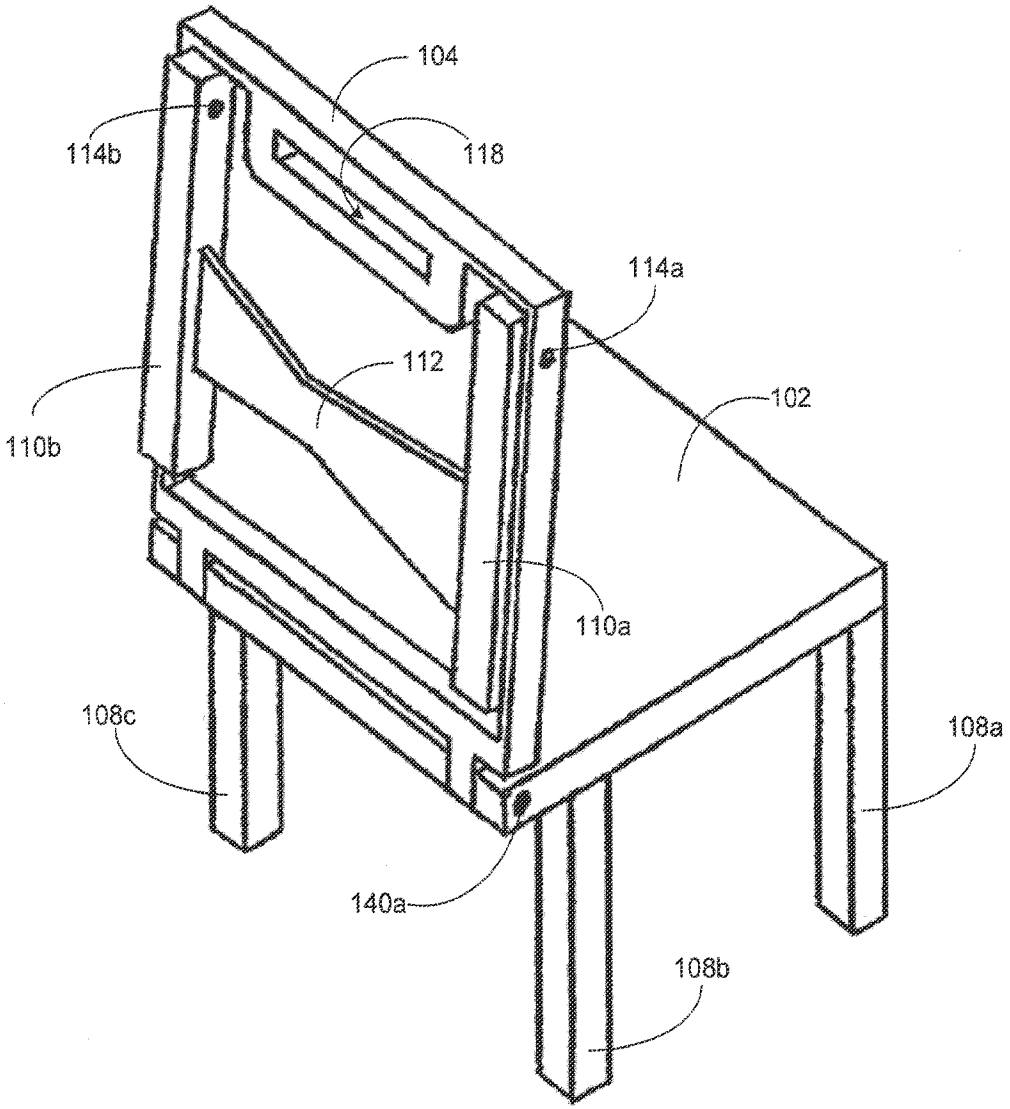
FIG. 2 depicts a schematic diagram of a perspective view of a transfer tub bench, in accordance with one embodiment of the present invention.

According to various embodiments, each leg can have a selectively adjustable height such that it can be extended and retracted. For example, each leg can be telescoping, pads on the feet or distal ends of the legs can be adjusted to various lengths (e.g., as by screw-type rotation), or each leg can be secured at various lengths through the use of a cotter-pin or other pin or detent-type assembly. In a particular embodiment, each leg can be individually adjustable. The transfer bench can thus be used in environments with uneven, sloped, or staggered-height surfaces and the first seating section can be maintained in a generally horizontal position to provide increased safety to the user. Likewise, when the second seating section is in the first position, it can lie in a substantially coplanar and horizontal orientation with relation to the first seating section. It is contemplated that the transfer bench can have legs that are of a height that is at least as tall as the predetermined height of the periphery. In various embodiments, one or more legs can be rotatably coupled to the first and/or second seating section. For example, in a particular embodiment, the leg(s) 110 supporting the second seating section 104 can be rotatably or hingedly coupled to the second seating section. As shown in FIG. 2, when the second seating section is rotated to a generally vertical position, the legs 110*a*, 110*b* can rotate to collapse or lie flat against the bottom surface of the second seating section. Other configurations for attaching the legs 110 to the second seating section, as well as means for folding the legs, such as but not limited to a spring loaded design, sideways folding mechanism, etc., are contemplated and are considered to be within the scope of the present invention.

In use, methods are disclosed for facilitating movement of a person into and out of an enclosure. The method comprises providing a transfer bench, such as described above according to various embodiments. For example, with reference to FIG. 3, a transfer bench can be provided that comprises a first seating section 102 supported by one or more legs 108 and a second seating section 104 rotatably coupled to the first seating section, and also supported by one or more respective legs 110. The method comprises positioning the transfer bench within an enclosure having a base and a periphery of a predetermined height such as, but not limited to, a bathtub 120. In a particular embodiment, the transfer bench is selectively positioned within the enclosure such that at least the first seating section is fully disposed within the periphery.

The second seating section can be configured to rotate from and between a first, generally horizontal, position and a second, generally vertical position. The method can further comprise positioning the second seating section to the first position, such that at least a portion of the second seating section extends beyond the periphery of the enclosure. For example, FIG. 3 illustrates a transfer bench in use in a standard bathtub. The transfer bench is placed in the bathtub such that the first seating section is entirely disposed within the periphery of the bathtub. The second seating section, when positioned in a generally horizontal position, extends beyond the periphery of the bathtub. In this position, the legs supporting the second seating section can be configured to extend downwardly to support the second seating section.

Legs supporting the first and second seating sections can be individually and selectively adjustable in height. The legs 108 supporting the first seating section can be manipulated to adjust the height of the first seating section, such that the legs are at least as tall as the predetermined height of the periphery. For example, in use in a bathtub, the legs can be adjusted to position the first seating section at a height that is at least as high as the wall of the bathtub, such that the second seating section can extend across the periphery without obstruction when in the first position. The legs can be adjusted, for example, if the base of the enclosure is uneven, sloped, etc., so that the first seating section can be maintained in a generally horizontal plane. The leg(s) supporting the second seating section can also be selectively adjusted. For example, if the floor surface outside of the enclosure is at a different level than the height of the base of the enclosure, the legs can be extended or retracted to maintain the first and second seating section in a substantially horizontal and coplanar arrangement when the second seating section is in the first position.

The method can further comprise receiving the person on the second seating section. The person can then be transferred to the first seating section. For example, a user of the transfer bench can sit on the second seating section and move to the first seating section by lifting each of the user's legs over the periphery of the enclosure (such as but not limited to a bathtub wall) and sliding or shifting toward the first seating section.

The method can further comprise rotating the second seating section from the first position to the second position, such as indicated by the arrows in FIG. 3. A handhold or other means can be provided to assist the person, or someone assisting the person in using the transfer bench, in rotating the second seating section. In a specific embodiment, it is contemplated that when the second seating section is in the generally vertical position, the transfer bench is substantially disposed within the periphery of the enclosure. In this position, a shower door, shower curtain, or other enclosure means can be drawn or extended to enclose the transfer bench within the enclosure. The legs supporting the second seating section can be rotatably coupled to the second seating section and configured to collapse or lie substantially flat against a bottom surface of the second seating section when in the generally vertical position.

Latching or securing means can be provided and/or manipulated to maintain the second seating section in the generally vertical position. Enclosure means can then be manipulated to at least partially enclose the enclosure, such as shown in FIG. 4. For example, a shower curtain 130, door, or other enclosure means can be pulled or drawn to enclose the enclosure. In a wet environment, enclosure means can be manipulated to enclose the enclosure and prevent water from spilling beyond the periphery of the enclosure. The person can then bathe, shower, etc. in a safely supported and seated position within the enclosure; the person can also utilize the upright second seating section as additional stabilizing means. As described above, a back support, arm rest, or both, can be provided to further support and/or stabilize the person.

To exit the enclosure, the person can manipulate the enclosure means to a position that allows the second seating section to be extended to a generally horizontal position. The second seating section can be rotated to this position and the person can move from the first seating section to the second seating section in a reverse manner than that described above.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

Figure 5:
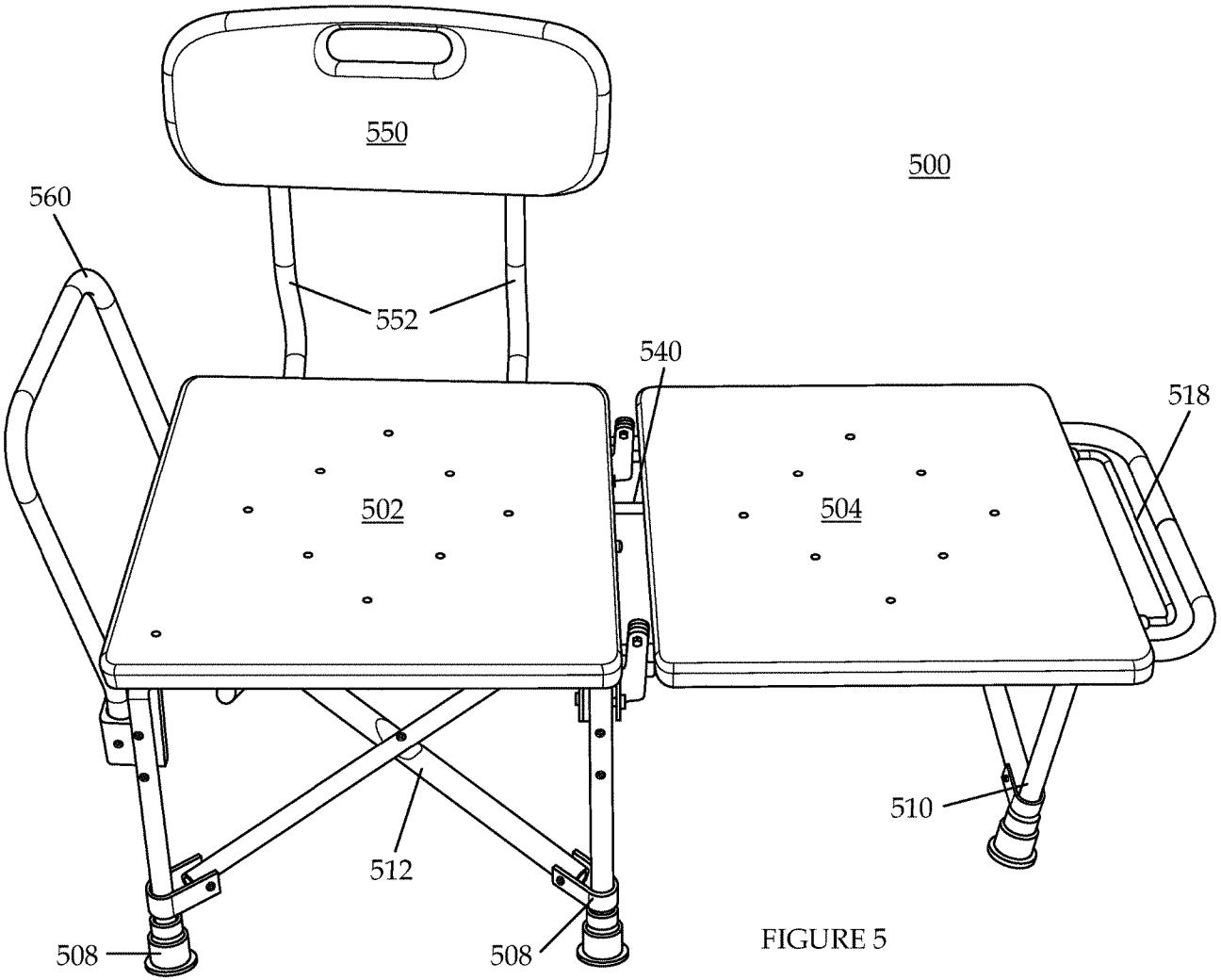
FIG. 5 depicts a perspective view of a transfer tub bench in accordance with another embodiment of the present invention.

FIG. 5 depicts a perspective view of a transfer bench in accordance with another embodiment of the present invention. As shown in FIG. 5, a transfer bench 500 generally comprises two seating sections, a first section 502 and a second section 504, a plurality of legs 508 for the first section 502, at least one leg 510 for the second section 504, wherein the second section 504 is rotatably connected to the first section about a common edge. As explained hereinabove, in various embodiments of the present invention, the second section 504 may be connection to the first section via a rotatable means, such as a mechanical hinge 540. It should also be noted, any of the legs 508, 510 may comprise a coating, cap, or similar non-slip material on a bottom thereof to ensure safety of the individual using the transfer bench 500.

The legs 508 of the first section 502 may generally be vertically positioned underneath the first section 502, such that the legs 508 support a predetermined maximum weight/load placed on the first section 502. In many embodiments, the legs 508 may be telescopic, or otherwise extendible, such that the legs 508 and the overall height of the transfer bench 500 can be adjusted for various applications. In such embodiments, the extendible feature may comprise a spring loaded button and slot system, a threaded extension system (i.e., which may be rotated along threads to raise or lower each leg), a clamp-type using a screw/bolt or similar mechanical device to hold an otherwise moveable leg in place within a sleeve, or the like. As shown in the Figure, the legs 508 may comprise a stiffening member 512, or similar structure, to support the load placed on the legs 508.

The leg 510 of the second section 504, may generally be vertically positioned underneath the second section 504, such that the leg 510 can support a predetermined maximum weight/load placed on the second section 504. In many embodiments, the leg 510 may be telescopic, or otherwise extendible, as described above with legs 508. Generally, any telescopic or extension features of the legs 508 are also provided on leg 510 such that the transfer bench 500 remains level.

In many embodiments, the leg 510 may be collapsible, such that the leg may rotate from a substantially vertical position, as shown in the Figure, to a flat position against the bottom surface of the second section. In such embodiments, the leg 510 may be substantially locked in a vertical position via a rotatable hinge (not shown) on the bottom surface of the second seating section 504, and may not be released and rotatable until a release mechanism is activated. In one embodiment, the release mechanism comprises a trigger or switch connected to a handle 518 positioned on an outer edge of the second section 504. A more detailed explanation of the structural and functional aspects of such embodiment are disclosed herein and shown in FIG. 6.

Figure 6:
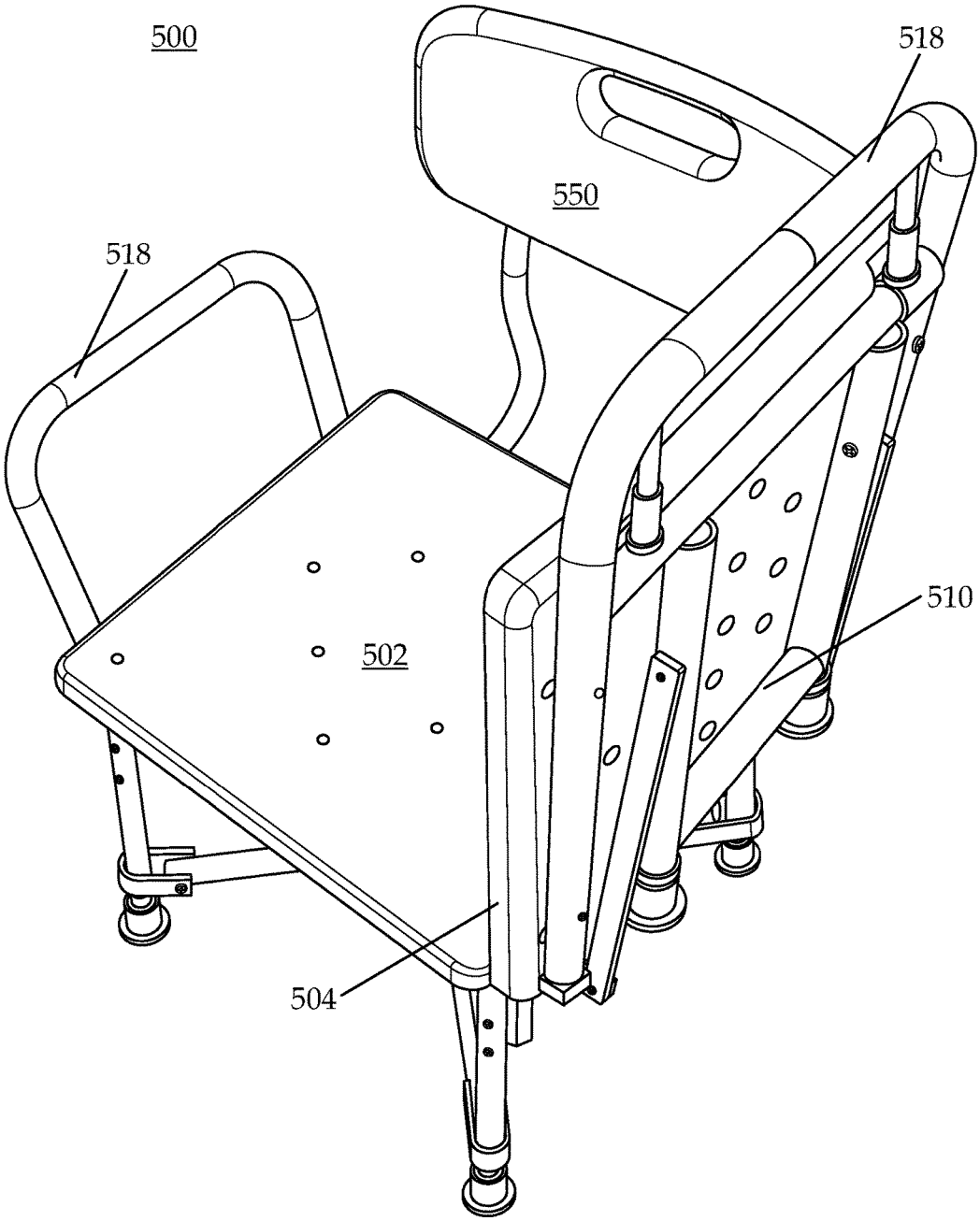
FIG. 6 depicts another perspective view of a transfer tub bench in accordance with another embodiment of the present invention.

FIG. 6 depicts another perspective view of a transfer tub bench in accordance with another embodiment of the present invention. As shown in the Figure, the second section 504 is capable of rotating from a substantially planar, horizontal position to a substantially vertical position, i.e., about 90 degrees of rotation. The leg 510 is shown in a substantially flat position against the bottom surface of the second section 504. In one embodiment, the leg 510 may be pushed down flat by a user's hand with nominal force. In another embodiment, the leg 510 may automatically lay flat as the second section is rotated into a vertical position by virtue of a mechanical arm or other structure, and as the second section is rotating towards a ninety degree position, the leg 510 is rotating towards a zero degree position. Optionally, by providing a release mechanism on the handle 518, or in another location, such release mechanism may permit both rotation of the second section 504 and rotation of the leg 510.

Returning to FIG. 5, the transfer bench 500 may further comprise a back support 550 and/or a primary handle 560. The primary handle 560 may comprise any protrusion, arm or member positioned on a side edge of the first section 502 opposite the common edge with the second section 504. The primary handle 560 may be utilized to support an individual while using the transfer bench 500. Often, the primary handle 560 is utilized to support the individual in conjunction with the handle 518 on the second section 504, when the second section 504 is in a vertical position.

The back support 550 may generally comprise at least one or more back support arms 552 for connecting to the first section 502. The back support 550, as described hereinabove, may provide general support for an individual while using the transfer bench 500. In some embodiments, the back support 550 may comprise an aperture or back support handle for ease of transport of the transfer bench 500.

The back support arms 552 may comprise one or more substantially tubular members which may be connected to the back support 550 on a first end and may be adapted for connecting with first section 502 on a second end. The back support arm 552 may be structured for connecting to the first section 502 via any suitable means, including those depicted in FIG. 7.

Figure 7:
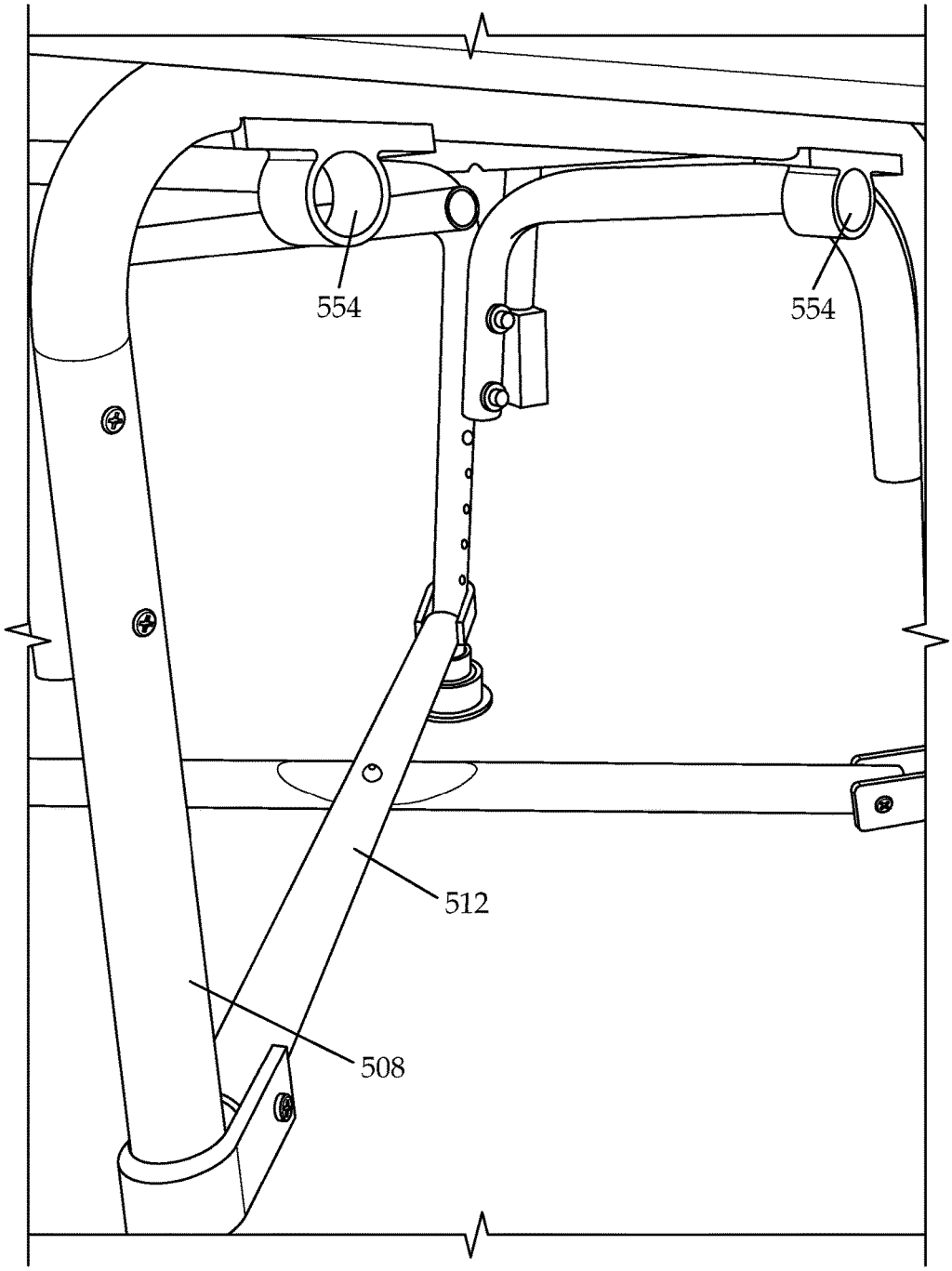
FIG. 7 depicts a bottom view of a section of a transfer tub bench in accordance with another embodiment of the present invention.
Figure 8A:
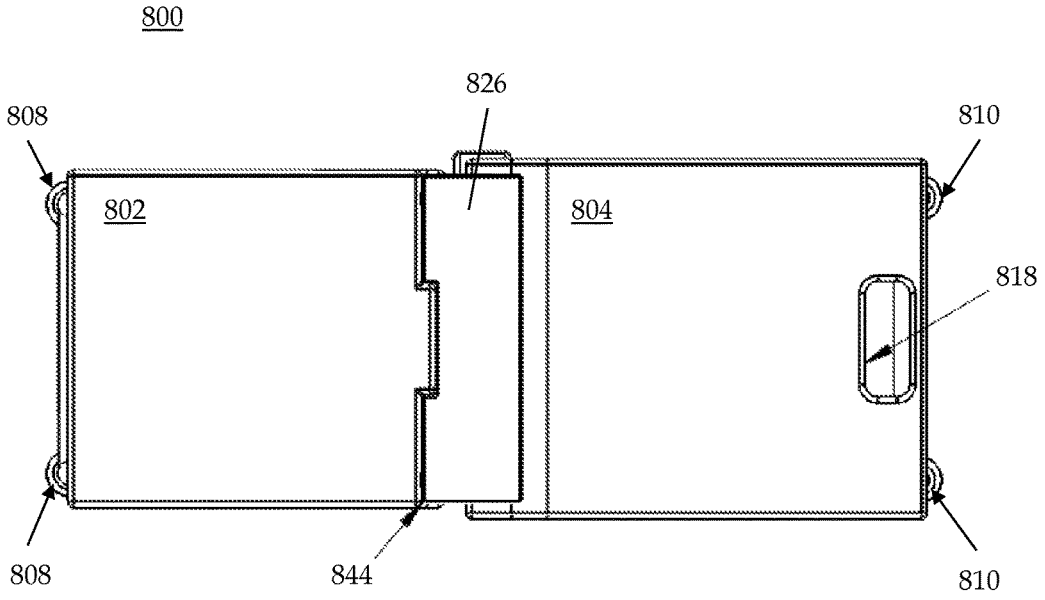
FIG. 8A depicts a top view of a transfer tub bench in accordance with another embodiment of the present invention.
Figure 8B:
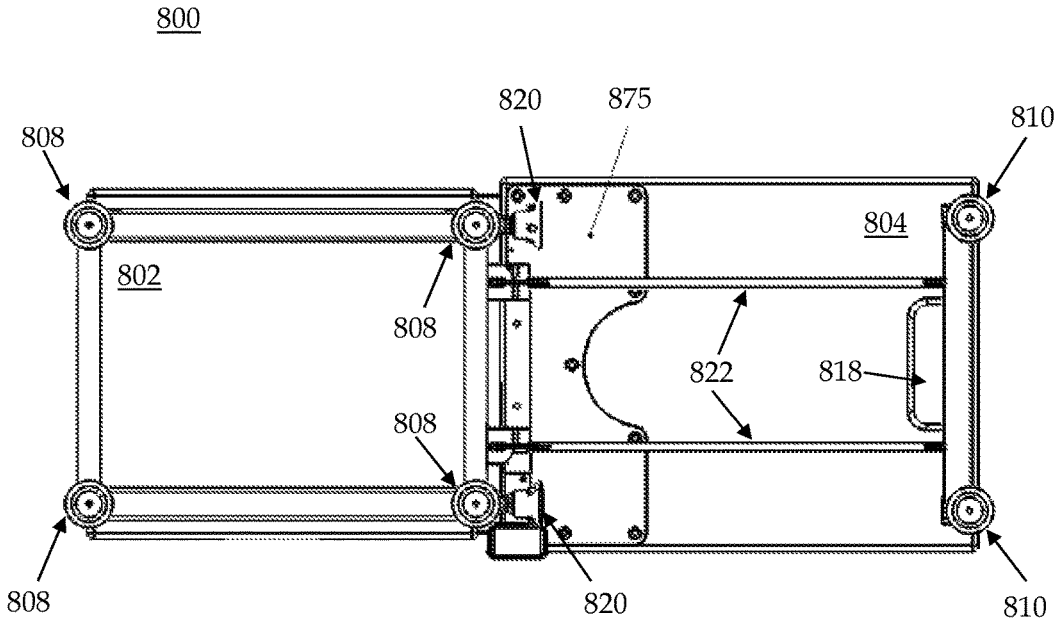
FIG. 8B depicts a bottom view of the transfer tub bench shown in FIG. 8A in accordance with another embodiment of the present invention.
Figure 8C:
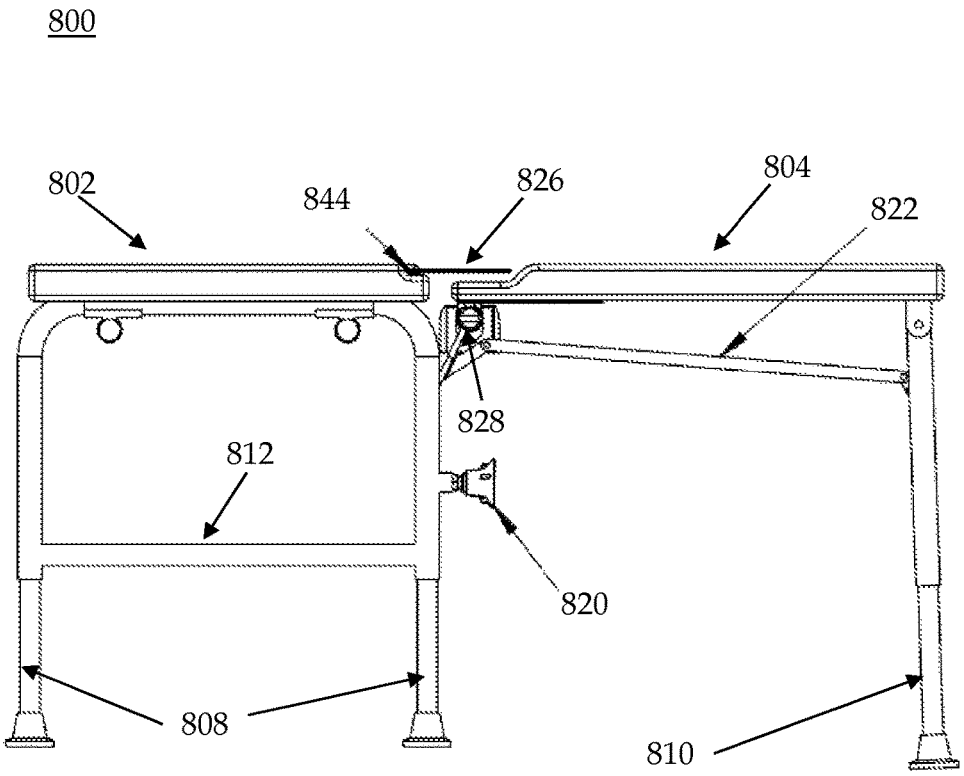
FIG. 8C depicts a front view of the transfer tub bench shown in FIG. 8A in accordance with another embodiment of the present invention.
Figure 8D:
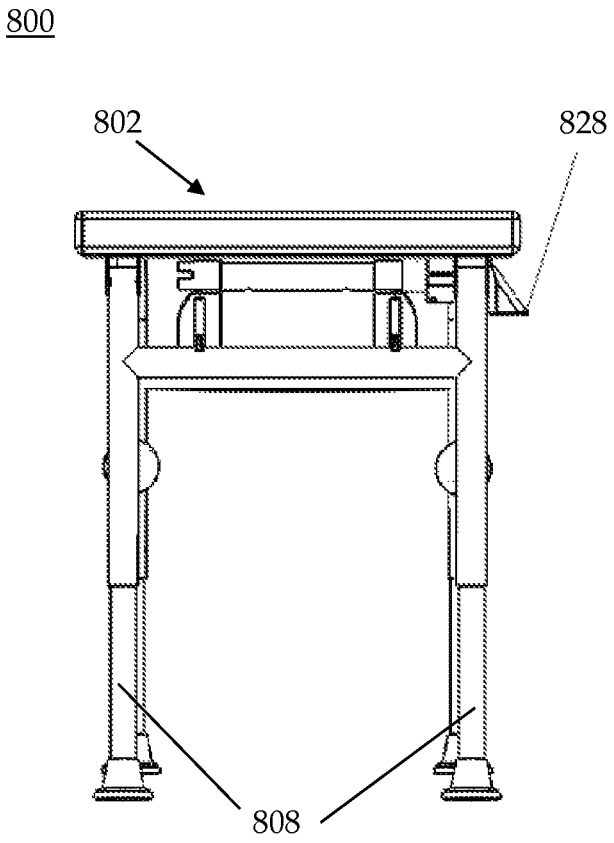
FIG. 8D depicts a side view of the transfer tub bench shown in FIG. 8A in accordance with another embodiment of the present invention.

FIG. 7 depicts a bottom view of a section of a transfer tub bench in accordance with another embodiment of the present invention. A bottom surface of the first section 502 generally comprises one or more back support arm receiving means 554. As shown in the Figure, the back support arm receiving means may comprise tubular structures having an aperture therethrough for receiving the second end of the back support arms 552. In such an embodiment, the second end of the back support arms 552 may comprise a substantially straight section of tube for fitting into and through the back support arm receiving means 554.

In many embodiments, there may be multiple back support arm receiving means 554 positioned on the bottom side of the first section 502. For example, in one embodiment, a set of back support arm receiving means 554 may be positioned on opposing sides of the first section 502, with such opposing sides being perpendicular to the sides with handle 560 and the common edge with the second section 504. As such, the back support 550 would be able to be interchanged between sides, making the transfer bench 500 adaptable for different set-up showers/bathtubs, i.e., left or right disposed shower heads from the side of entry of the bathtub.

In a further embodiment of the present invention (not shown), a transfer bench may be provided that has only a single seating section, disposed on rails that extend between a first section and a second section, otherwise substantially similar to embodiments of the present invention described above. In such an embodiment, the transfer bench may be positioned as shown in FIG. 3 above. An individual may sit on the seating section, and by virtue of the sliding rails, may slide from the second section to the first section, thereby allowing such individual to go from outside a bathtub, to inside the bathtub by sliding the slidable seating section. Once the individual is positioned within the bathtub, in the first section position, the individual may raise the second section as described hereinabove. When the individual has completed bathing, the second section may be lowered, and the slidable seating section may be slid from the first section to the second section, and the individual may stand up outside the bathtub, or easily transfer his/herself to a wheelchair or other assistance device.

FIGS. 8A-8D depict views of a transfer bench 800 in accordance with another embodiment of the present disclosure. As shown in FIGS. 8A-8D a transfer bench 800 may comprise two seating sections, a first section 802 and a second section 804, a plurality of legs 808 for the first section 802, at least one leg 810 for the second section 804, wherein the second section 804 is rotatably connected to the first section 802. As explained hereinabove, in various embodiments of the present invention, the second section 804 may be connected to the first section via a rotatable means, such as a mechanical hinge. It should also be noted, any of the legs 808, 810 may comprise a coating, cap, or similar non-slip material on a bottom thereof to ensure safety of the individual using the transfer bench 800.

The legs 808 of the first section 802 may generally be vertically positioned underneath the first section 802, such that the legs 808 support a predetermined maximum weight/load placed on the first section 802. In many embodiments, the legs 808 may be telescopic, or otherwise extendible, such that the legs 808 and the overall height of the transfer bench 800 can be adjusted for various applications. In such embodiments, the extendible feature may comprise a spring loaded button and slot system, a threaded extension system (i.e., which may be rotated along threads to raise or lower each leg), a clamp-type using a screw/bolt or similar mechanical device to hold an otherwise moveable leg in place within a sleeve, or the like. As shown in the Figure, the legs 808 may comprise a stiffening member 812, or similar structure, to support the load placed on the legs 808.

The at least one leg 810 of the second section 804, may generally be vertically positioned underneath the second section 804, such that the leg 810 can support a predetermined maximum weight/load placed on the second section 804. In many embodiments, the leg 810 may be telescopic, or otherwise extendible, as described above with legs 808. Generally, any telescopic or extension features of the legs 808 are also provided on leg 810 such that the transfer bench 800 remains level.

In many embodiments, a leg 810 may be collapsible, such that the leg 810 may rotate from a substantially vertical position, as shown in the Figure, to a flat position against the bottom surface of the second section 804. In such embodiments, the leg 810 may be substantially locked in a vertical position via an extension member 822, which may be substantially rigid, on a bottom surface of the second seating section 804, and may not be released and rotatable until a release mechanism 828 is activated. A release mechanism 828 may disengage/unlock an engaged/locked extension member 822 to allow rotation of the second seating section 804.

In some embodiments, the release mechanism 828 may comprise a handle disposed generally in a center portion between the first section 802 and the second section 804. A release mechanism 828 may be positioned on or around the first section 802 and the second section 804 in a location that allows a patient or user to activate the release mechanism 828 while seated on the first section 802 or the second section 804. In some embodiments, the release mechanism 828 may comprise lever, handle, a trigger, switch, and/or the like connected to a handle, or the like, positioned in a center portion between the first section 102 and the second section 804. In some embodiments, a release mechanism 288 may be positioned in alternative locations, such as on an outer edge of the first section 802, on an edge of the second section 804, in any suitable location for releasing the extension member 822, and/or the like. In some embodiments, the extension member 822 may comprise a bar adapted to pull at least one leg 810 into a closed position during rotating of the second section 804.

In some embodiments, the bench 800 may comprise a flap 826, or the like, that may substantially cover any gap between the first section 802 and the second section 804 on a top surface of the bench 800, thereby improving comfort of the user. The flap 826 may be connected to one of the sections 802, 804 via a hinge 844, or the like. The hinge 844 may be configured to allow the flap 826 to rotate when the second section 804 is rotated upwardly. The flap 826 may be generally rectangular in shape, or may be shaped to cover any gap between the sections 802, 804, or the like.

In some embodiments, a bench 800 may also comprise a horizontal support 820, such as a suction cup, or the like, that may allow the bench to attach to a horizontal surface to increase stability of the bench 800. In some embodiments, the horizontal support 820 may comprise a suction cup, or the like, and may be positioned on a leg 808 or a portion of the first section 802. In some embodiments, the horizontal support 820 may extend perpendicularly away from a leg 808 of the first section 802, improving horizontal stability, or the like, when the horizontal support 820 is engaged or attached with a horizontal surface, such as a wall or the interior of a bathtub, or the like. In some embodiments, a horizontal support 820 may comprise a suction cup that may be adapted to adhere to an interior surface of a bathtub to substantially prevent the bench 800 from dislodging or moving away from the surface of the bathtub, or the like. In some embodiments, the bench 800 may comprise a supporting plate 826 for joint stability. The plate 826 may comprise metal, hard plastic, steel, or the like and may be positioned on the underside of one or more of the sections 802, 803.

As shown in the Figures, the second section 804 may be adapted to rotate from a substantially planar, horizontal position to a substantially vertical position, i.e., about 45-180 degrees of rotation. In one embodiment, the second section 804 may rotate to about 80 degrees when measured from the horizontal position of the first section 802. A leg 810 is shown in a substantially perpendicular position in relation to a bottom surface of the second section 804. In one embodiment, the leg 810 may be pushed down flat by a user's hand with nominal force. In another embodiment, the leg 810 may automatically lay flat as the second section is rotated into a vertical position by virtue of an extension 822 or other structure, and as the second section is rotating towards a 45-90 degree position, the leg 810 is rotating towards a zero degree position. Optionally, by providing a release mechanism 828 on the sections 802, 804, on a handle 818, or in another location, such release mechanism 828 may permit both rotation of the second section 804 and rotation of the leg 810.

In another embodiment of the present invention, the transfer bench may be affixed to a bathtub, such that it is mechanically connected thereto. Any of the embodiments described herein may be utilized to create such a bathtub assembly. In such embodiments, the legs of the first section may be screwed, bolted, adhered, friction fit, or otherwise affixed to a surface of a bathtub, and each of the other functions described herein may still work accordingly.

While the foregoing is directed to embodiments of the present invention, other and further embodiments of the invention may be devised without departing from the basic scope thereof. It is also understood that various embodiments described herein may be utilized in combination with any other embodiment described, without departing from the scope contained herein. In addition, embodiments of the present invention are further scalable, as particular applications may require.

What is claimed is:

1. A transfer bench comprising:

a first seating section;

a second seating section rotatably coupled to said first seating section and configured to rotate from and between a substantially horizontal position to a substantially vertical position, wherein the second seating section cannot rotate more than about 90 degrees from the horizontal position;

a first plurality of legs configured to support the first seating section;

a second leg configured to support the second seating section; and a release mechanism adapted to release at least the second leg from a locked position to a rotatable position.

2. The transfer bench of claim 1, further comprising:

a handle extending from the second seating section on a side of the second seating section opposing the first seating section.

3. The transfer bench of claim 1, wherein the second leg is rotatable from a first position being substantially perpendicular to the second seating section, to a second position being substantially flat against a bottom surface of the second seating section.

4. The transfer bench of claim 3, wherein the second leg rotates from its first position to its second position as the second seating section rotates from its substantially horizontal seating position to its substantially vertical seating position.

5. A bathtub assembly comprising:

a bathtub having an enclosure, the enclosure comprising a tub having a floor surface and sidewalls; and a transfer bench comprising:

a first seating section;

a second seating section rotatably coupled to said first seating section and configured to rotate from and between a substantially horizontal position to a substantially vertical position, wherein the second seating section cannot rotate more than about 90 degrees from the horizontal position;

a first plurality of legs configured to support the first seating section;

a second leg configured to support the second seating section; and a release mechanism adapted to release at least the second leg from a locked position to a rotatable position.

6. The transfer bench of claim 5, further comprising:

a handle extending from the second seating section on a side of the second seating section opposing the first seating section.

7. The transfer bench of claim 5, wherein the second leg is rotatable from a first position being substantially perpendicular to the second seating section, to a second position being substantially flat against a bottom surface of the second seating section.

8. The transfer bench of claim 5, wherein the second leg rotates from its first position to its second position as the second seating section rotates from its substantially horizontal seating position to its substantially vertical seating position.

* * * * *